US009715197B2

(12) United States Patent
Seshita et al.

(10) Patent No.: US 9,715,197 B2
(45) Date of Patent: Jul. 25, 2017

(54) FIXING DEVICE AND IMAGE FORMING APPARATUS INCORPORATING FIXING DEVICE

(71) Applicants: Takuya Seshita, Kanagawa (JP); Yuji Arai, Kanagawa (JP); Takahiro Imada, Kanagawa (JP); Hajime Gotoh, Kanagawa (JP); Akira Suzuki, Tokyo (JP); Motoyoshi Yamano, Kanagawa (JP)

(72) Inventors: Takuya Seshita, Kanagawa (JP); Yuji Arai, Kanagawa (JP); Takahiro Imada, Kanagawa (JP); Hajime Gotoh, Kanagawa (JP); Akira Suzuki, Tokyo (JP); Motoyoshi Yamano, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 15/202,878

(22) Filed: Jul. 6, 2016

(65) Prior Publication Data

US 2017/0010569 A1 Jan. 12, 2017

(30) Foreign Application Priority Data

Jul. 9, 2015 (JP) ..... 2015137606
Jan. 13, 2016 (JP) ..... 2016004356

(51) Int. Cl.
*G03G 15/20* (2006.01)

(52) U.S. Cl.
CPC ..... *G03G 15/205* (2013.01); *G03G 15/2078* (2013.01); *G03G 2215/2035* (2013.01)

(58) Field of Classification Search
CPC ..... G03G 15/205; G03G 15/2039; G03G 15/2042; G03G 15/2046; G03G 15/2078; G03G 15/2082
See application file for complete search history.

(56) References Cited

U.S. PATENT DOCUMENTS

2005/0139584 A1* 6/2005 Kishi ..... G03G 15/2003 219/202
2006/0177232 A1 8/2006 Ehara et al.
(Continued)

FOREIGN PATENT DOCUMENTS

JP 2006-208419 8/2006
JP 2006-221139 8/2006
(Continued)

*Primary Examiner* — David M Gray
*Assistant Examiner* — Carla Therrien
(74) *Attorney, Agent, or Firm* — Duft Bornsen & Fettig, LLP

(57) ABSTRACT

A fixing device includes a fixing rotator, a heat source, a controller, a pressure rotator, and a nip formation pad. The controller controls the heat source such that a temperature of the fixing rotator is equal to a preset fixing temperature. The nip formation pad abuts the pressure rotator via the fixing rotator and forms a nip between the fixing rotator and the pressure rotator. When a print time of a previous job is longer than a prescribed time A and a next job is started within a prescribed time B after an end of the previous job, the controller corrects the preset fixing temperature during a time from a start of the next job to an entry of a print sheet into the nip and during a time from the entry of the print sheet into the nip to a lapse of a prescribed time C after the entry.

7 Claims, 10 Drawing Sheets

(56) References Cited

U.S. PATENT DOCUMENTS

| | | | | |
|---|---|---|---|---|
| 2011/0222888 | A1 | 9/2011 | Ikebuchi et al. | |
| 2011/0229227 | A1 | 9/2011 | Yoshikawa et al. | |
| 2011/0286758 | A1* | 11/2011 | Yoshinaga ..... | G03G 15/2039 399/69 |
| 2012/0114345 | A1 | 5/2012 | Fujimoto et al. | |
| 2012/0177393 | A1 | 7/2012 | Ikebuchi et al. | |
| 2012/0224878 | A1 | 9/2012 | Ikebuchi et al. | |
| 2013/0022366 | A1 | 1/2013 | Ando | |
| 2013/0136479 | A1 | 5/2013 | Yuasa et al. | |
| 2013/0183072 | A1 | 7/2013 | Hase et al. | |
| 2013/0195477 | A1 | 8/2013 | Seshita et al. | |
| 2013/0195493 | A1 | 8/2013 | Hase et al. | |
| 2013/0202320 | A1 | 8/2013 | Hase et al. | |
| 2013/0209115 | A1 | 8/2013 | Hase et al. | |
| 2013/0209119 | A1 | 8/2013 | Yuasa et al. | |
| 2013/0209121 | A1 | 8/2013 | Uchitani et al. | |
| 2013/0209125 | A1 | 8/2013 | Uchitani et al. | |
| 2013/0209131 | A1 | 8/2013 | Uchitani et al. | |
| 2014/0016972 | A1 | 1/2014 | Seshita et al. | |
| 2014/0133879 | A1 | 5/2014 | Seshita et al. | |
| 2015/0078770 | A1 | 3/2015 | Yamano et al. | |
| 2015/0185671 | A1 | 7/2015 | Ikebuchi et al. | |
| 2015/0261149 | A1 | 9/2015 | Seshita et al. | |

FOREIGN PATENT DOCUMENTS

| | | |
|---|---|---|
| JP | 2007-233011 | 9/2007 |
| JP | 2013-025045 | 2/2013 |

* cited by examiner

FIXING DEVICE AND IMAGE FORMING APPARATUS INCORPORATING FIXING DEVICE

CROSS-REFERENCE TO RELATED APPLICATIONS

This patent application is based on and claims priority pursuant to 35 U.S.C. §119(a) to Japanese Patent Application Nos. 2015-137606, filed on Jul. 9, 2015, and 2016-004356 filed on Jan. 13, 2016 in the Japan Patent Office, the entire disclosure of each of which is hereby incorporated by reference herein.

BACKGROUND

Technical Field

Aspects of the present disclosure relate to a thermal fixing device and an image forming apparatus, such as an electrophotographic copier, a printer, or a facsimile, incorporating the fixing device.

Related Art

An image forming apparatus forms a toner image on an image bearer based on image information transfers the toner image onto a recording material, such as a paper sheet or an overhead projector (OHP) sheet, and passes the recording material bearing the toner image through a fixing device to fix the toner image onto the recording material under heat and pressure.

There is increasing market demand for energy saving and speed-up in such an image forming apparatus.

SUMMARY

In an aspect of the present disclosure, there is provided a fixing device that includes a fixing rotator, a heat source, a controller, a pressure rotator, and a nip formation pad. The heat source heats the fixing rotator. The controller controls the heat source such that a temperature of the fixing rotator is equal to a preset fixing temperature. The pressure rotator contacts an outer surface of the fixing rotator. The nip formation pad inside the fixing rotator abuts the pressure rotator via the fixing rotator and forms a nip between the fixing rotator and the pressure rotator. When a print time of a previous job is longer than a prescribed time A and a next job is started within a prescribed time B after an end of the previous job, the controller corrects the preset fixing temperature during a time from a start of the next job to an entry of a print sheet into the nip and during a time from the entry of the print sheet into the nip to a lapse of a prescribed time C after the entry.

In an aspect of the present disclosure, there is provided an image forming apparatus comprising the fixing device.

BRIEF DESCRIPTION OF THE SEVERAL VIEWS OF THE DRAWINGS

The aforementioned and other aspects, features, and advantages of the present disclosure would be better understood by reference to the following detailed description when considered in connection with the accompanying drawings, wherein.

Figure 1:
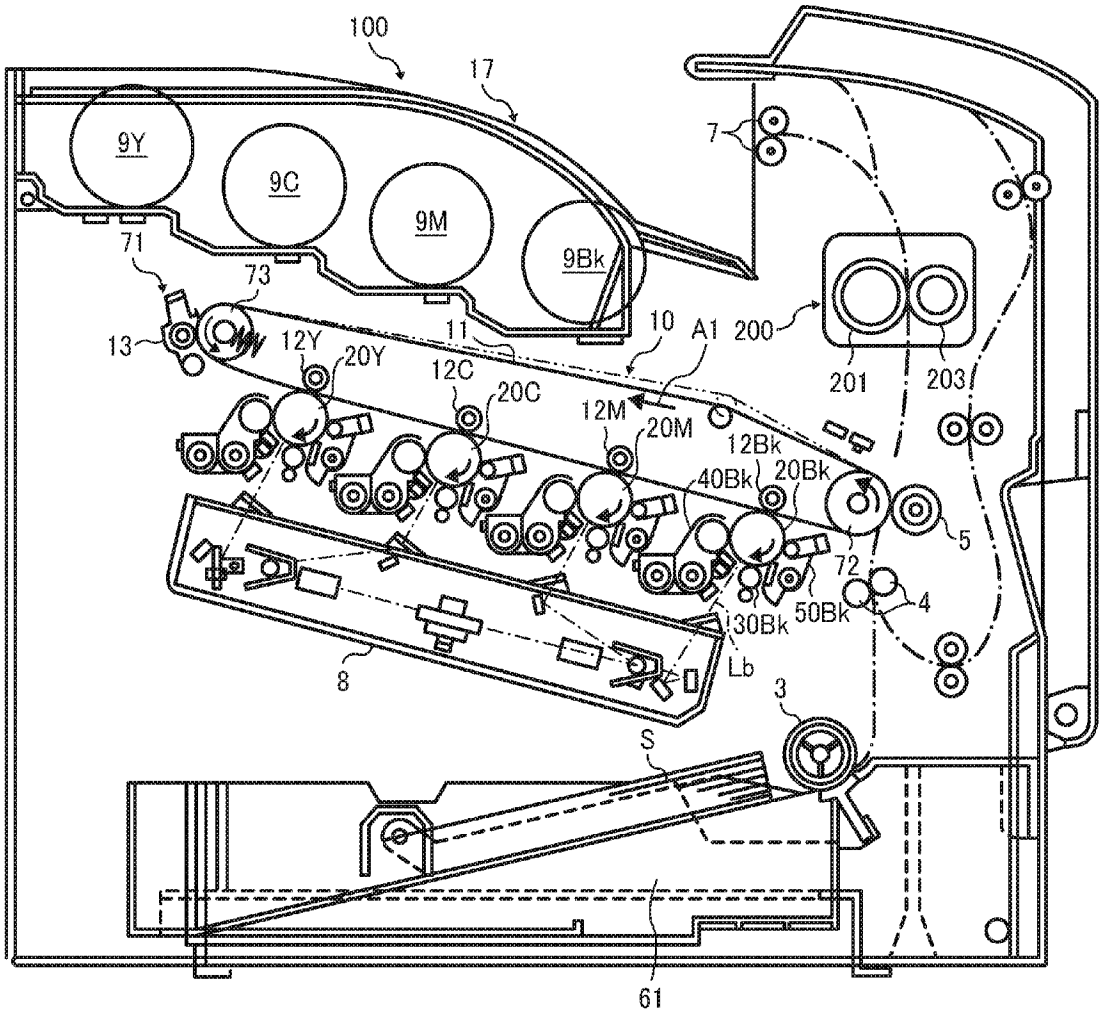
FIG. 1 is a schematic configuration diagram of an image forming apparatus according to an embodiment of the present disclosure.

The accompanying drawings are intended to depict embodiments of the present disclosure and should not be interpreted to limit the scope thereof. The accompanying drawings are not to be considered as drawn to scale unless explicitly noted.

DETAILED DESCRIPTION

In describing embodiments illustrated in the drawings, specific terminology is employed for the sake of clarity. However, the disclosure of this patent specification is not intended to be limited to the specific terminology so selected and it is to be understood that each specific element includes all technical equivalents that operate in a similar manner and achieve similar results.

Although the embodiments are described with technical limitations with reference to the attached drawings, such description is not intended to limit the scope of the disclosure and all of the components or elements described in the embodiments of this disclosure are not necessarily indispensable.

Referring now to the drawings, embodiments of the present disclosure are described below. In the drawings for explaining the following embodiments, the same reference codes are allocated to elements (members or components) having the same function or shape and redundant descriptions thereof are omitted below.

A configuration of an image forming apparatus according to an embodiment of the present disclosure is described below with reference to FIG. 1. The image forming apparatus illustrated in FIG. 1 is a tandem-system color printer in which image forming units are disposed side by side along a stretched direction of a belt to form a plurality of color images. However, the present disclosure is not limited to this system but may be a copier, a facsimile, or the like instead of a printer. The image forming apparatus 100 has a tandem structure in which photoconductor drums 20Y, 20C, 20M, and 20Bk are disposed side by side as image bearers capable of forming images in correspondence with color separation into yellow, cyan, magenta, and black.

In the image forming apparatus 100 illustrated in FIG. 1, by the execution of a primary transfer process, visible images formed on the photoconductor drums 20Y, 20C, 20M, and 20Bk are superimposing transferred onto a transfer belt 11 as an intermediate transfer body using an endless belt movable in a direction indicated by arrow A1 while being opposed to the photoconductor drums 20Y, 20C, 20M, and 20Bk. After that, by the execution of a secondary transfer process, the images on the intermediate transfer body are collectively transferred onto a recording medium S such as a recording sheet.

Devices for performing image formation process along with the rotation of the photoconductor drums are disposed on the peripheries of the photoconductor drums. Taking the photoconductor drum 20Bk for formation of a black image as an example, a charging device 30Bk, a developing device 40Bk, a primary transfer roller 12Bk, and a cleaning device 50Bk are disposed along the rotation direction of the photoconductor drum 20Bk to perform image formation process. An optical writing device 8 is used for writing after the charging of the photoconductor drums.

The superimposing transfer onto the transfer belt 11 are performed in the course of movement of the transfer belt 11 in the direction A1 with timings shifted from the upstream to downstream sides of the direction A1 by voltage application from primary transfer rollers 12Y, 12C, 12M, and 12Bk opposed to the photoconductor drums 20Y, 20C, 20M, and 20Bk with the transfer belt 11 therebetween, such that the visible images formed on the photoconductor drums 20Y, 20C, 20M, and 20Bk are transferred and overlapped at the same position on the transfer belt 11.

The photoconductor drums 20Y, 20C, 20M, and 20Bk are disposed side by side in this order from the upstream side of the direction A1. The photoconductor drums 20Y, 20C, 20M, and 20Bk are included in image stations for forming yellow, cyan, magenta, and black images, respectively.

The image forming apparatus 100 includes: four image stations performing image formation process in respective colors; a transfer belt unit 10 that is opposed to the upper side of the photoconductor drums 20Y, 20C, 20M, and 20Bk and includes the transfer belt 11 and the primary transfer rollers 12Y, 12C, 12M, and 12Bk; a secondary transfer roller 5 as a transfer roller that is opposed to the transfer belt 11 and is entrained and rotated by the transfer belt 11; a cleaning device 13 that is opposed to the transfer belt 11 to clean the top of the transfer belt 11; and the optical writing device 8 as an optical writing device that is opposed to the lower side of the four image stations.

The optical writing device 8 includes a semiconductor laser as a light source, a coupling lens, an fθ lens, a toroidal lens, a folding mirror, and a rotary polygon mirror as a deflector. The optical writing device 8 emits writing light Lb corresponding to the respective colors (for the sake of convenience, FIG. 1 has a reference sign given only to the image station for black image, and the same thing applies to the other image stations) to the photoconductor drums 20Y, 20C, 20M, and 20Bk to form electrostatic latent images on the photoconductor drums 20Y, 20C, 20M, and 20Bk.

The image forming apparatus 100 includes: a sheet feeding device 61 as a sheet feed cassette that has a stack of recording media S conveyed between the photoconductor drums 20Y, 20C, 20M, and 20Bk and the transfer belt 11; paired registration rollers (paired position adjustment rollers) 4 that feed the recording medium S conveyed from the sheet feeding device 61 to transfer portions between the photoconductor drums 20Y, 20C, 20M, and 20Bk and the transfer belt 11 at predetermined timings suited to the timings for formation of toner images by the image stations; and a sensor that detects that the leading end of the recording medium S has reached the paired registration rollers 4.

The image forming apparatus 100 also includes: a fixing device 200 of a roller fixing system to fix the transferred toner images to the recording medium S; a sheet ejection roller 7 that ejects the recording medium S with the fixed toner images outside the apparatus body of the image forming apparatus 100; a sheet ejection tray 17 that is disposed on the upper portion of the image forming apparatus 100 and has a stack of the recording media S ejected outside the apparatus body of the image forming apparatus 100 by the sheet ejection roller 7; and toner bottles 9Y, 9C, 9M, and 9Bk that are positioned under the sheet ejection tray 17 and are charged with yellow, cyan, magenta, and black toners, respectively.

The transfer belt unit 10 has a drive roller 72 and a driven roller 73 on which the transfer belt 11 is mounted as well as the transfer belt 11 and the primary transfer rollers 12Y, 12C, 12M, and 12Bk.

The driven roller 73 also has the function of a tension biasing member for the transfer belt 11. Accordingly, the driven roller 73 is provided with a biasing member such as a spring. The transfer belt unit 10, the primary transfer rollers 12Y, 12C, 12M, and 12Bk, the secondary transfer roller 5, and the cleaning device 13 constitute a transfer device 71.

The sheet feeding device 61 is disposed in the lower part of the apparatus body of the image forming apparatus 100 and has a feed roller 3 as a sheet feed roller in contact with the upper surface of the uppermost recording medium S. The feed roller 3 is driven to rotate counterclockwise to feed the uppermost recording medium S to the paired registration rollers 4.

The cleaning device 13 included in the transfer device 71 has a cleaning brush and a cleaning blade opposed to and contacting with the transfer belt 11. The cleaning brush and the cleaning blade scrape a foreign substance such as residual toner off the transfer belt 11 to clean the transfer belt 11.

The cleaning device 13 also has a discharge unit to carry out the residual toner from the transfer belt 11 and discard the same.

Figure 2:
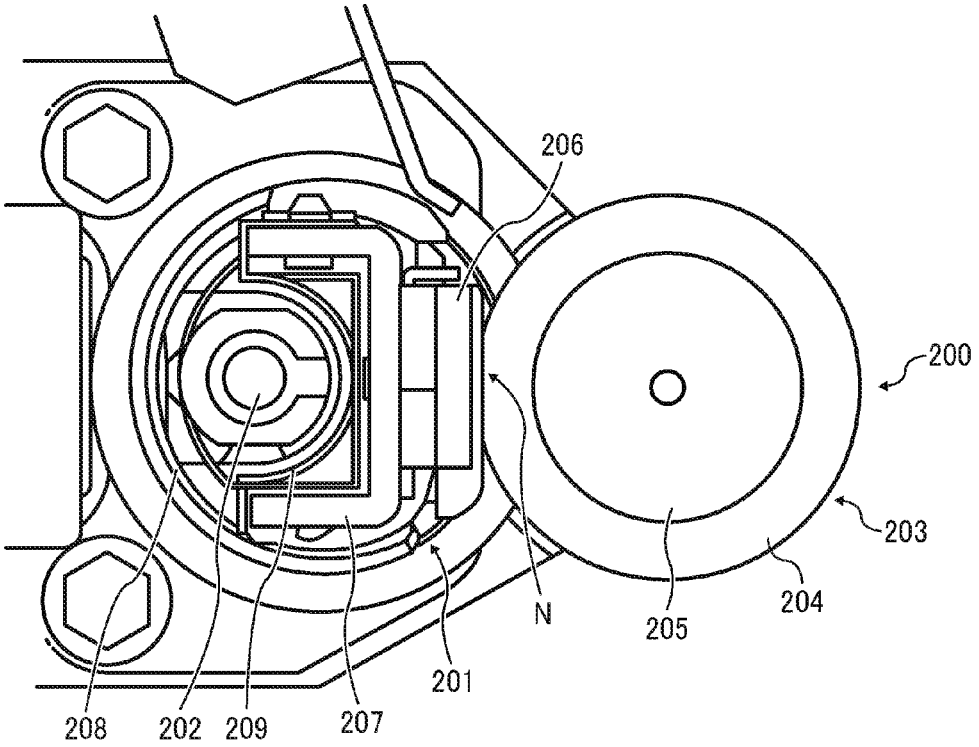
FIG. 2 is a schematic configuration diagram of a fixing device in the image forming apparatus illustrated in FIG. 1.

FIG. 2 is a cross-sectional view of the fixing device according to the present embodiment. The fixing device 200 has a fixing belt 201 as a fixing rotator and a pressure roller 203 as a pressure rotator. The fixing belt 201 includes a halogen heater 202 as a heat source that heats directly the fixing belt 201 from the inner circumferential side by radiation heat. The fixing device 200 also has in the fixing belt 201 a nip formation pad 206 forming a nip N in conjunction with the pressure roller 203 via the fixing belt 201 on the side opposed to the pressure roller 203. The nip formation pad 206 slides on the inner face of the fixing belt directly or via a slide sheet.

The nip N has a flat shape in the configuration of FIG. 2, but may have a recessed shape or any other shape instead. By forming the recessed nip, the ejection direction of the leading end of the recording medium comes closer to the pressure roller, thereby to improve the separability of the recording medium from the fixing belt and suppress the occurrence of paper jam.

The fixing belt 201 is a metallic belt of nickel or steel use stainless (SUS) or an endless belt (or film) made of a resin material such as polyimide. The surface layer of the belt has a release layer made of a tetrafluoroethylene-perfluoalkylvinylether copolymer (PFA) or a tetrafluoride ethylene resin (PTFE) to impart releasability for prevention of toner adhesion. An elastic layer formed from a silicon rubber layer or the like may be interposed between the belt base and the PFA or PTFE layer. Without the silicon rubber layer, heat capacity becomes small to improve the fixing property. However, when an unfixed image is pressed and fixed at the nip N, fine asperities on the belt surface are transferred to the image and orange peel-like uneven gloss is generated on the image solid portion (orange-peel image). To correct this disadvantage, a silicon rubber layer of 100 μm or more needs to be provided. The silicon rubber layer deforms and absorbs the fine asperities to correct the orange-peel image.

The fixing belt 201 also includes a stay 207 as a support for supporting the nip to prevent the bending of the nip formation pad 206 under pressure from the pressure roller 203 and obtain an even nip width in an axial direction (vertical to the sheet surface). The stay 207 is made of a metallic material for rigidness. The stay 207 is held and secured by the axial ends to the side plates for positioning. The nip formation pad 206 is complicated in shape and is desirably an injection-molded article of a heat-resistant resin. The desirable type of the heat-resistant resin is liquid crystalline polymer (LCP) (heat-resistant temperature is about 330° C.), poly ether ketone (PEK) (heat-resistant temperature is about 350° C.), or the like. In addition, a reflector 209 is interposed between the halogen heater 202 and the stay 207 to reflect radiation heat and the like from the halogen heater 202. This suppresses energy wasting resulting from the heating of the stay 207 by the radiation heat and the like.

Instead of including the reflector 209, adiabatic treatment or mirror finishing may be performed on the surface of the stay 207 to obtain the same advantage. The heat source may be the halogen heater 202, an induction heater (IH), a resistance heat generator, a carbon heater, or the like.

The pressure roller 203 includes a metal core 205, an elastic rubber layer 204 provided on the metal core, and a release layer (PFA or PTFE layer) provided on the surface for releasability. The pressure roller 203 rotates with transmission of a driving force from a drive source such as a motor provided in the image forming apparatus 100 via a gear. The pressure roller 203 is pressed by a spring or the like against the fixing belt 201 side, and the elastic rubber layer 204 is crushed and deformed to have a predetermined nip width.

The pressure roller 203 may be a hollow roller with a heat source such as a halogen heater therein. The elastic rubber layer 204 may be made of solid rubber or sponge rubber when there is no heater in the pressure roller 203. The use of sponge rubber is more desirable because the heat of the fixing belt 201 is unlikely to be absorbed due to increased heat-insulating properties.

The fixing belt 201 is entrained and rotated by the pressure roller 203. In the case of the fixing device 200 illustrated in FIG. 2, the pressure roller 203 is rotated by a drive source to transmit a driving force from the nip N to the fixing belt 201 and rotate the fixing belt 201. The fixing belt 201 is rotated in the state of being caught in the nip N, and is guided and run by a holder (flange) 208 at the both end portions excluding the nip. The recording medium S is heated and pressurized while passing through the nip N for fixing processing. According to the configuration described above, it is possible to implement the fast warming-up fixing device at low costs.

Figure 3:
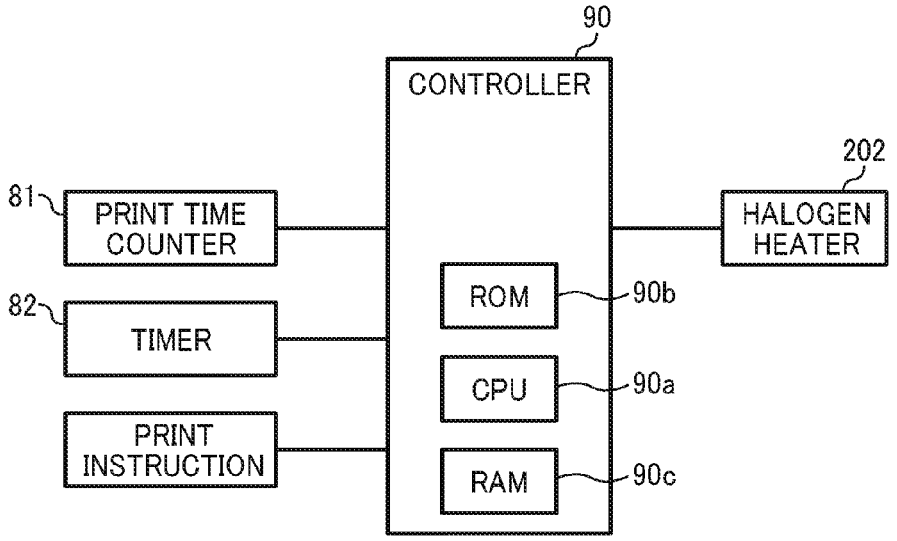
FIG. 3 is an illustration of a functional configuration of a controller in the fixing device illustrated in FIG. 1.

Next, a functional configuration of a controller 90 is described. As illustrated in FIG. 3, the controller 90 has a central processing unit (CPU) 90*a* as a computing processor, a read-only memory (ROM) 90*b* as a storage device, a random access memory (RAM) 90*c* as a non-volatile memory, and others. The controller 90 connects to a print time counter 81 to acquire information on print time (sheet passage time) measured by the print time counter 81. The controller 90 also connects to a timer 82 to acquire information on time measured by the timer 82. The controller 90 controls the halogen heater 202 such that the fixing device 200 reaches a target fixing temperature (preset fixing temperature) based on an instruction for a print job (print instruction), the print time measured by the print time counter 81, the time measured by the timer 82, and others. The controller 90 also controls the entire apparatus to control driving of the devices based on control programs stored in the RAM 90*c* or the ROM 90*b*. The print job refers to a batch of image formation processing in correspondence with one print request (or print work output according to one print request). In the print job, image formation may be performed on one sheet or on a plurality of sheets by continuous sheet passage.

For energy saving and speed-up, printing operation may be started in a state in which a fixing device is not warm at initial sheet passage. In such a case, a temperature drop might occur in areas in which end portions of a sheet pass and hamper good fixing performance at the end portions of the sheet.

Figure 10:
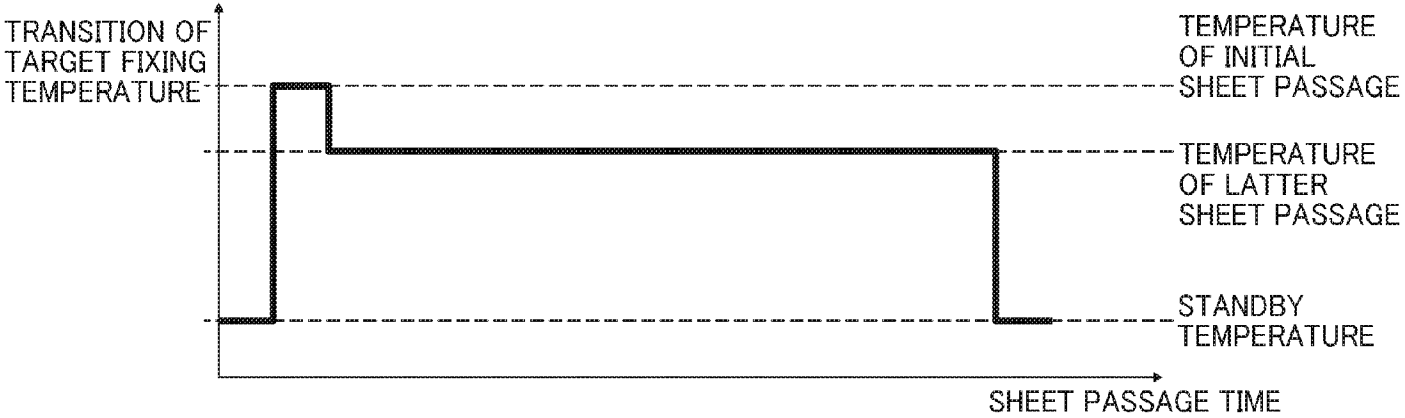
FIG. 10 is an illustration of transition of target fixation temperature in a conventional fixing device.
Figure 11:
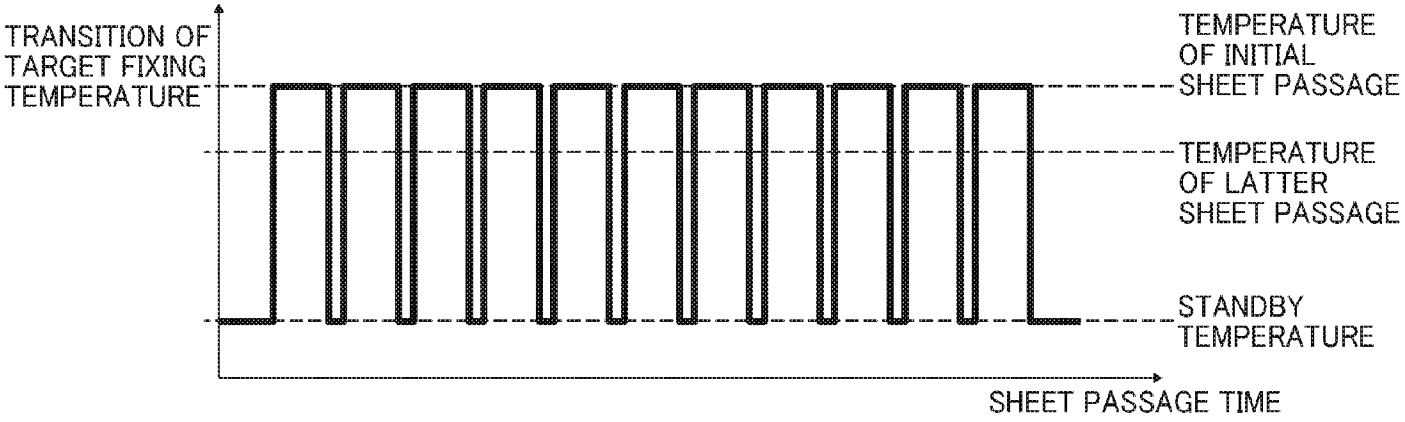
FIG. 11 is an illustration of transition of target fixation temperature in a conventional fixing device.

Hence, for example, as illustrated in FIG. 10, raising the setting temperature at initial sheet passage may allow reductions in recovery time, cost, and power consumption. However, in such a fixing device, if a small amount of print job is repeated at short intervals many times as illustrated in FIG. 11, sheet passage would be repeated many times within a period of time of initial sheet passage in which the setting temperature is raised. As a result, the product life of the fixing device might extremely decrease. In addition, as the repeat of print jobs advances, heat might accumulate in the fixing device, thus causing hot offset and gloss reduction of a print image. Hence, the controller 90 according to the present embodiment performs a temperature control as described below.

Figure 4:
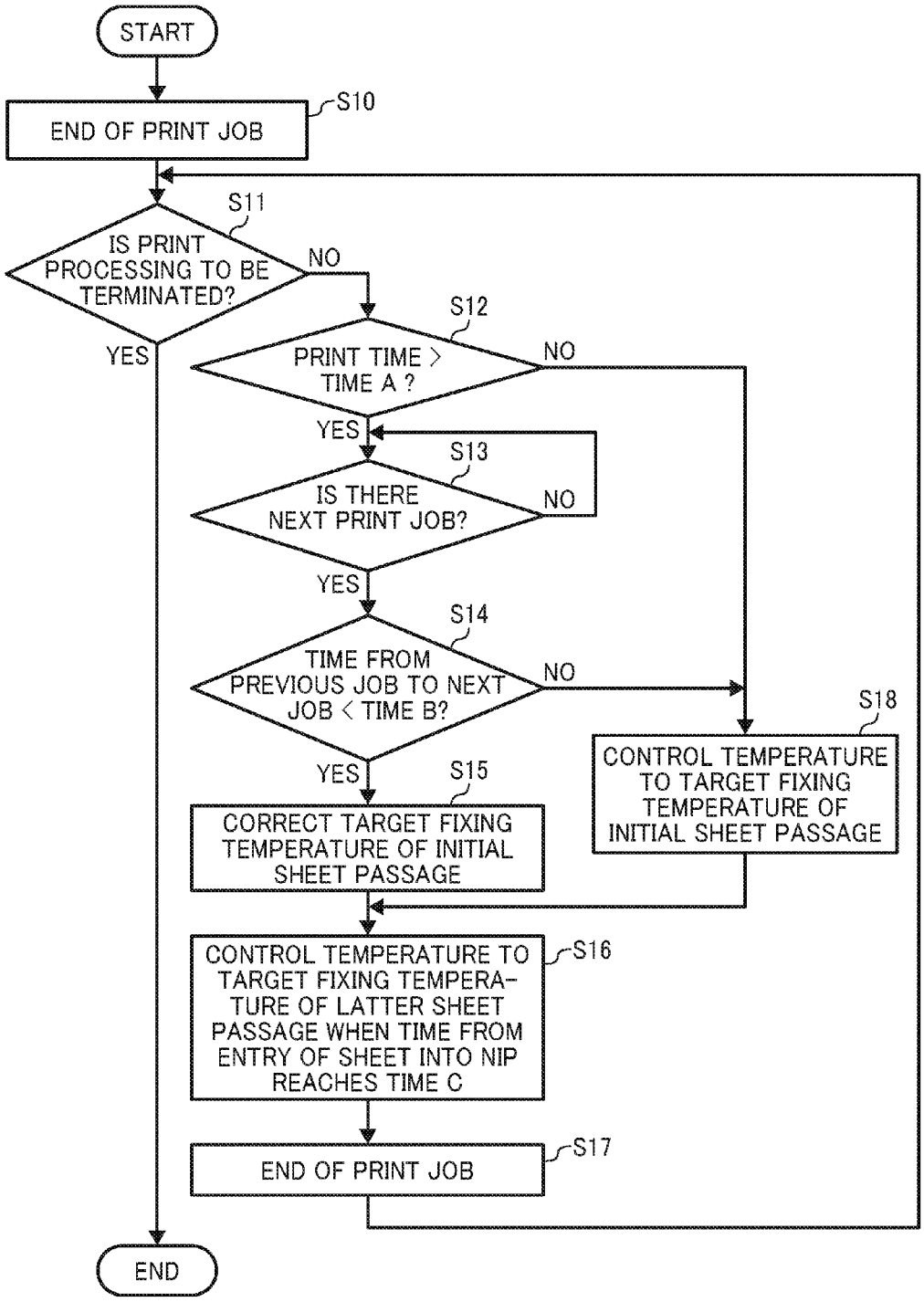
FIG. 4 is a flowchart of a control by the controller in the fixing device illustrated in FIG. 1.

An example of the control of the halogen heater 202 by the controller 90 is described referring to the flowchart described in FIG. 4. The flowchart is a mere example of a routine that can provide the advantage of the present disclosure in the present embodiment. Needless to say, any other flowchart can be also applied as far as it can provide the advantage of the present disclosure.

Prescribed time A refers to a sheet-passage-time determination threshold for the previous print job (previous job) for determining whether to perform the control or not. Prescribed time B refers to a time from the end of the previous job to the start of the next print job (next job), that is, a job interval for determining whether to perform the control or not. Prescribed time C refers to a time since the entry into the nip N in which temperature correction needs to be made to the initial sheet passage temperature for the next job.

First, the print processing is started. Upon the end of the print job (step S10), the controller 90 determines whether the print processing is to be terminated (step S11). When determining that the print processing is to be terminated (YES at step S11), the controller 90 terminates the print processing. When determines that the print process is not to be terminated (NO at step S11), at the controller 90 determines whether the print time for the previous print job (previous job) is longer than the prescribed time A (step S12). When determining that the print time of the previous print job (previous job) is not longer than the prescribed time A (NO at step S12), the controller 90 moves the process to step S18. When determining that the print of the previous print job (previous job) is longer than the prescribed time A (YES at step S12), the controller 90 determines whether there is the next print job (step S13). When determining that there is not the next print job (NO at step S13), the controller 90 returns to step S13. When determining that there is the next print job (YES at step S13), the controller 90 determines whether the time from the end of the previous job to the start of the next print job (next job) is shorter than the prescribed time B (step S14). When determining that the time from the end of the previous job to the start of the next job is shorter than the prescribed time B (YES at step S14), the controller 90 corrects the target fixing temperature of initial sheet passage and execute the print job (step S15), and then moves to step S16. When determining that the time from the end of the previous job to the start of the next job is not shorter than the prescribed time B (NO at step S14), the controller 90 controls the fixing temperature to the target fixing temperature of initial sheet passage and executes the print job (step S18), and then moves to step S16. After moving to step S16, when the time from the entry of the print sheet into the nip N reaches the prescribed time C, the controller 90 controls the fixing temperature to the target fixing temperature of latter sheet passage, and executes the print job (step S16). That is, the controller 90 corrects the preset fixing temperature during the time from the start of the next job to the entry of the print sheet into the nip N and during the time from the entry of the print sheet into the nip N to the lapse of the prescribed time C after the entry. Then, upon end of the print job (step S17), the controller 90 returns to step S11 to repeat steps S12 to S18 until completion of the printing.

Figure 5:
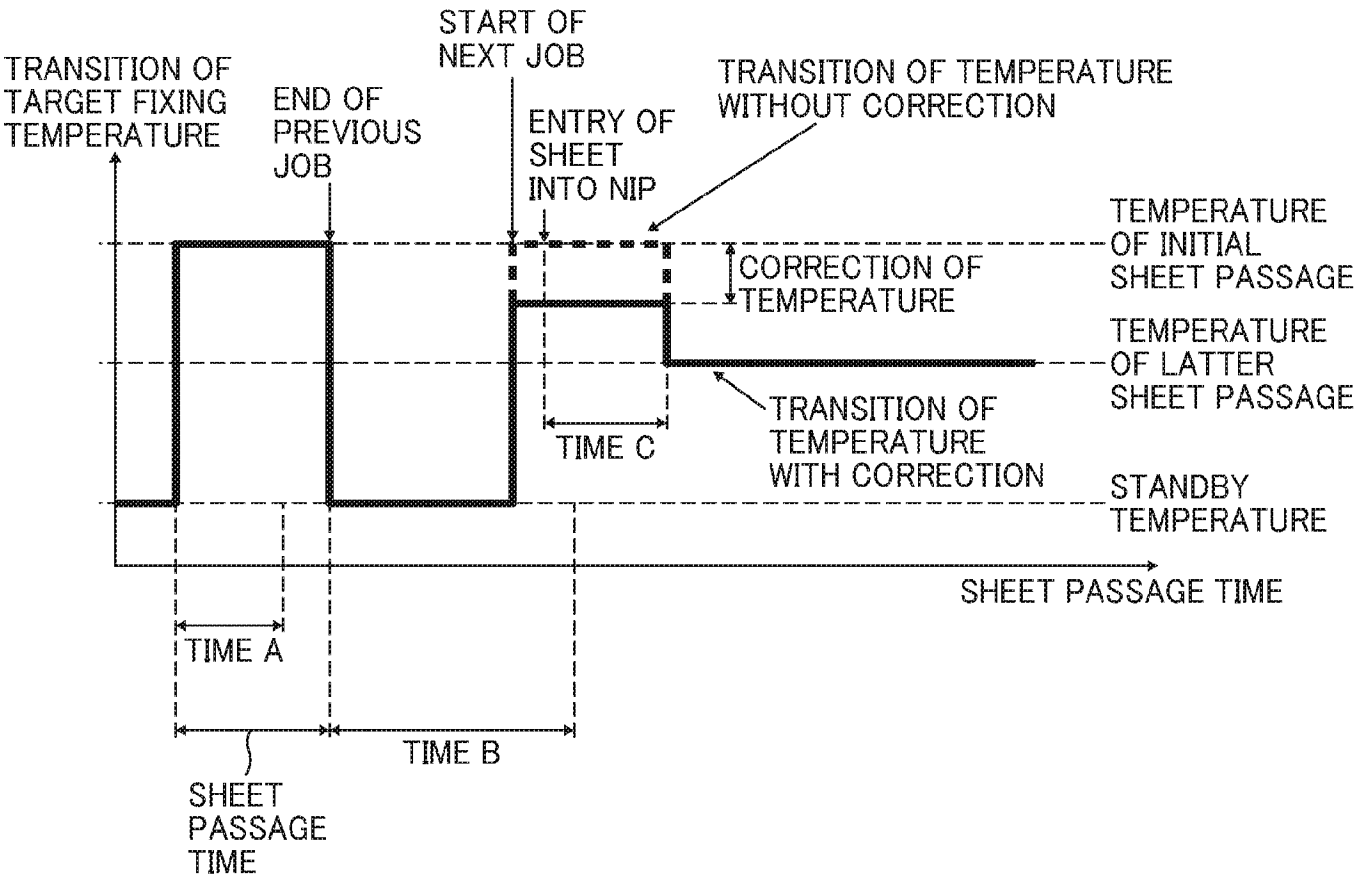
FIG. 5 is an illustration of transition of target fixation temperature in the fixing device illustrated in FIG. 1.

Next, referring to FIG. 5, the control of the halogen heater 202 by the controller 90 is described in correspondence with the flowchart. FIG. 5 illustrates target fixing temperature transition in the case where the print operation is terminated with the print time for the previous job exceeding the prescribed time A and then the print operation for the next job is started within the prescribed time B, corresponding to the flow of steps S10 to S16.

In this case, the controller 90 corrects the target fixing temperature during the time from the start of the next job to the entry of the print sheet into the nip N and during the time from the entry into the nip N to the lapse of the prescribed time C after the entry. That is, the target fixing temperature of initial sheet passage in the next job can be lowered within the prescribed time B because of heat storage in the previous job. Accordingly, the preset temperature of initial sheet passage can be kept from being increased. This suppresses degradation of the components. In addition, hot offset and gloss reduction can be prevented in the repetition of small-amount print jobs.

Figure 6:
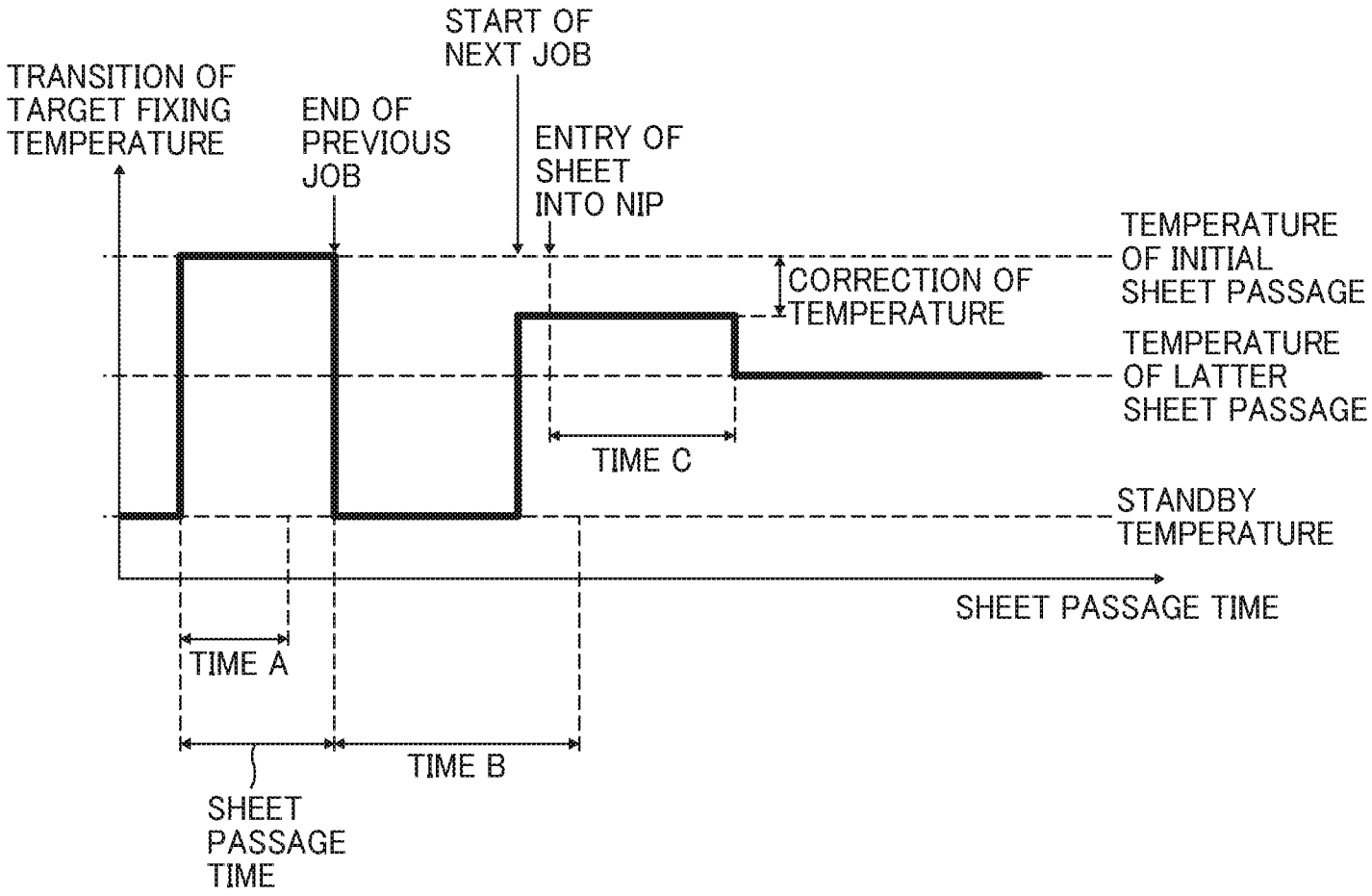
FIG. 6 is an illustration of transition of target fixation temperature in the fixing device illustrated in FIG. 1.

At least one of the prescribed time A, the prescribed time B, the prescribed time C, and the amount of correction to the target fixing time can be changed as appropriate. For example, as illustrated in FIG. 6, when the previous job is completed beyond the prescribed time A, it is necessary to set the prescribed time B and the prescribed time C to be shorter as the print time for the previous job is shorter, and it is also necessary to reduce the amount of correction to the target fixing temperature of initial sheet passage in the next job.

Figure 7:
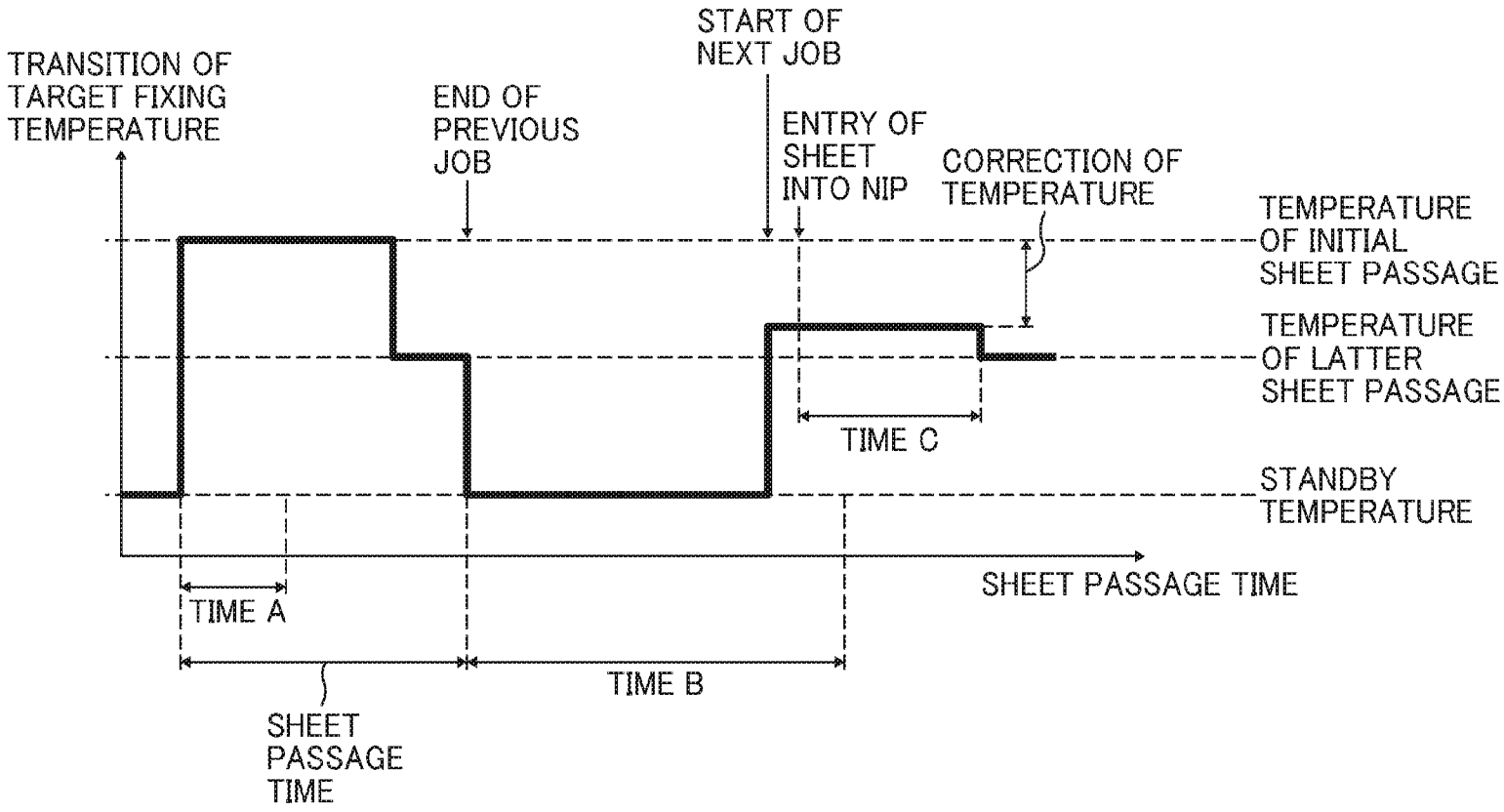
FIG. 7 is an illustration of transition of target fixation temperature in the fixing device illustrated in FIG. 1.

Meanwhile, as illustrated in FIG. 7, when the previous job is terminated beyond the prescribed time A, it is possible to set the prescribed time B and the prescribed time C to be longer as the print time for the previous job is longer, and it is also necessary to increase the amount of correction to the target fixing temperature of initial sheet passage in the next job.

Therefore, it is desirable to prepare a plurality of combinations of the prescribed time A, the prescribed time B, and the prescribed time C, and select an optimum combination of the prescribed time A, the prescribed time B, and the prescribed time C as appropriate according to the print time of the previous job.

The amount of heat storage in the fixing device varies depending on the print mode. The print mode refers to a publicly known mode in which printing is carried out according to process linear velocity, paper thickness, color mode, sheet size, and others.

The amount of heat storage in the fixing device varies in different print modes. For example, there is a difference between the amount of heat storage by sheet passage for a specific time at a high linear velocity and a high temperature and the amount of heat storage by sheet passage for a specific time at a low linear velocity and a low temperature. Accordingly, it is desirable to decide the prescribed time A and the prescribed time B as appropriate based on the print mode for the previous job, and decide the prescribed time C and the amount of correction to the fixing set temperature as appropriate based on the print mode for the next job.

In some combinations of the print modes for the previous job and the next job, the target fixing temperature cannot be corrected in the same manner. Therefore, the prescribed time A, the prescribed time B, the prescribed time C, and the amount of correction to the target fixing temperature are selected as appropriate based on the relationship between the print modes for the previous job and the next job. Accordingly, the prescribed time A, the prescribed time B, the prescribed time C, and the amount of correction to the target fixing temperature can be set more properly for the next job.

The prescribed time C is desirably prescribed in correspondence with the previously prescribed time of the target fixing temperature of initial sheet passage. The preset time of the target fixing temperature of initial sheet passage refers to the time during which it is necessary to raise the preset temperature to assure the fixing property of the ends of the paper. The target fixing temperature can be corrected in the next job until lapse of the prescribed time C. In this case, the corrected target fixing temperature cannot be made lower than the target fixing temperature of latter sheet passage. Accordingly, the upper limit for the amount of correction to the target fixing temperature needs to be a temperature increased from the target fixing temperature of initial sheet passage.

Figure 8:
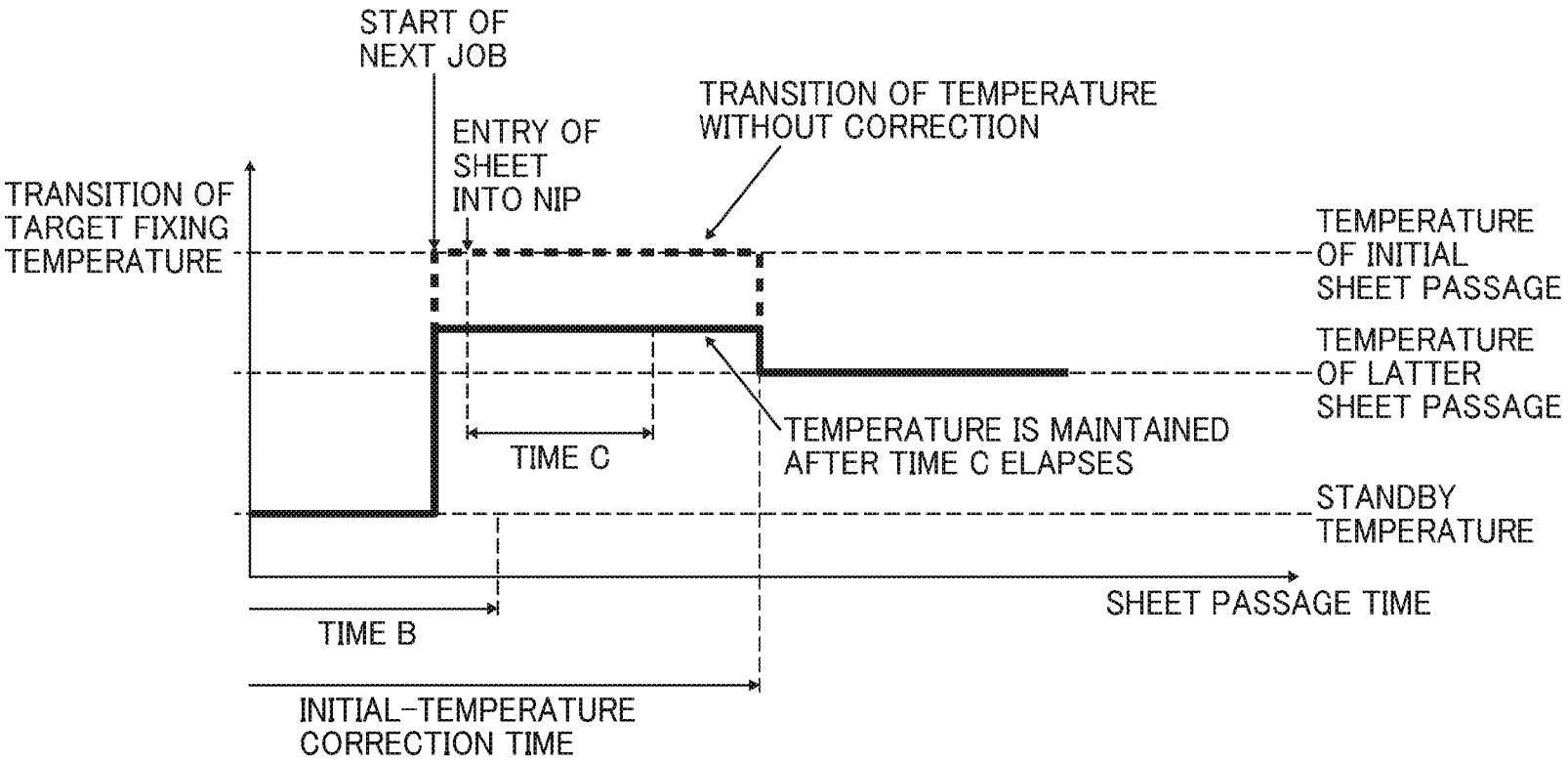
FIG. 8 is an illustration of transition of target fixation temperature in the fixing device illustrated in FIG. 1.

The prescribed time C and the amount of correction to the target fixing temperature may be prescribed based on the relationship between the previous job and the next job regardless of the time during which the target fixing temperature of initial sheet passage is raised. In this case, as illustrated in FIG. 8, when the prescribed time C is set to be shorter than the time during which the target fixing temperature is raised in initial sheet passage (initial-temperature correction time), there is no need to raise the temperature for the period of time from the lapse of the prescribed time C to the lapse of the time during which the target fixing temperature of initial sheet passage is raised. Therefore, the same preset temperature is desirably maintained for the period of time from the lapse of the prescribed time C and the lapse of the time during which the target fixing temperature of initial sheet passage is raised.

Figure 9:
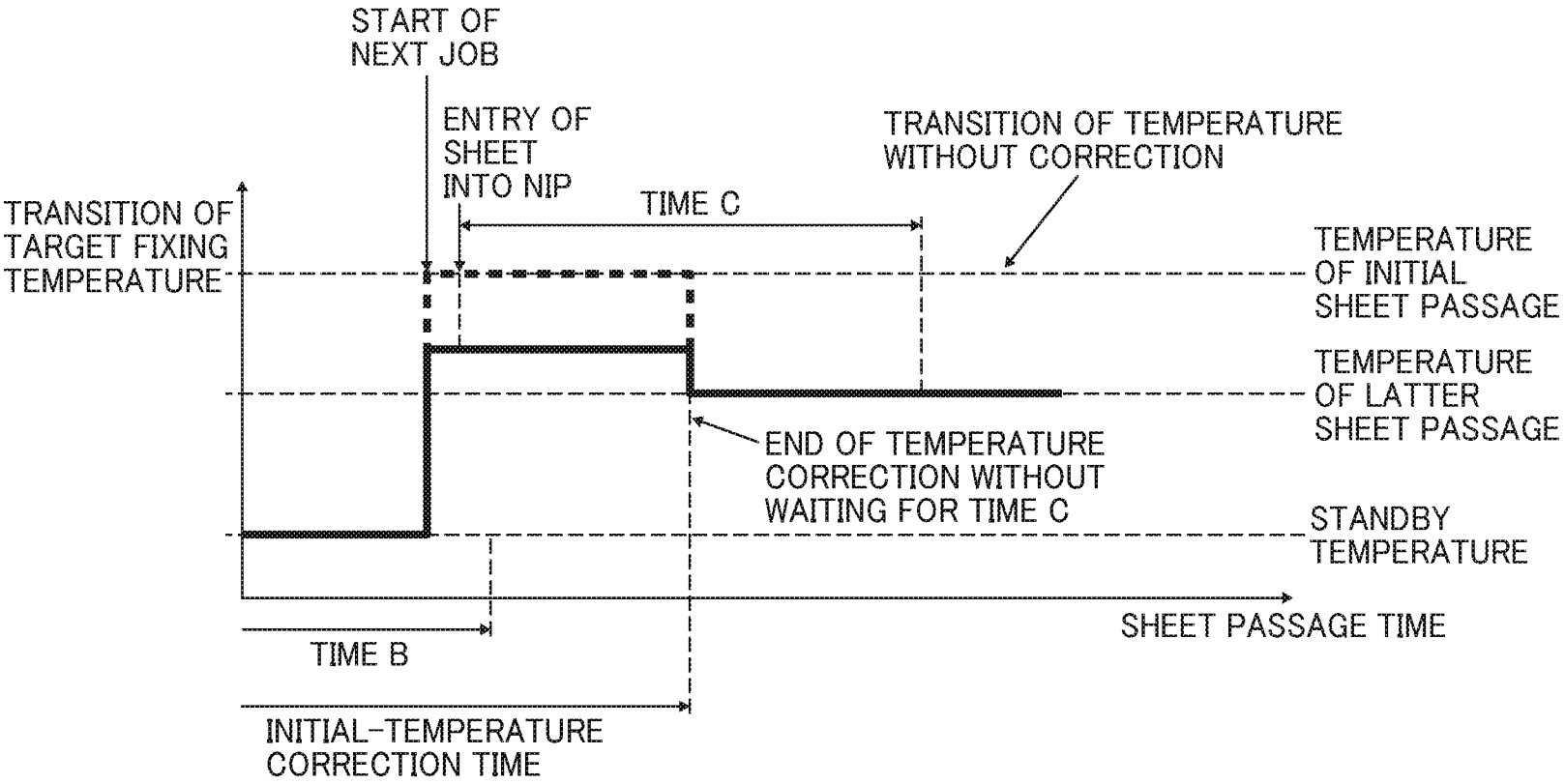
FIG. 9 is an illustration of transition of target fixation temperature in the fixing device illustrated in FIG. 1.

When the prescribed time C is set to be longer than the time during which the target fixing temperature of initial sheet passage is raised, it is desirable to terminate the correction of the target fixing temperature upon the lapse of the time during which the target fixing temperature of initial sheet passage is raised as illustrated in FIG. 9.

The print time count is desirably started from the start of print operation for one job, and terminated when the print operation for the job is completed, for example. This makes it possible to determine the amount of heat storage in the fixing device in a more accurate manner. The timing for starting to turn on the heater may vary depending on the image forming apparatus. Therefore, it is desirable to select the proper timing for print time count as appropriate according to the machine type.

The print time count is also desirably corrected when there are fluctuations in inter-sheet time during the counting of the print time for a job. For example, when the inter-sheet time lasts long at the time of process control or the like, for example, the sheet does not absorb heat from the fixing device and thus heat storage is facilitated. Accordingly, the heat storage status cannot be presumed properly. Therefore, when there are fluctuations in the inter-sheet time during the counting of the print time for a job, the print time count is corrected by a little larger amount. This makes it possible to determine the amount of heat storage in the fixing device in a more accurate manner. The amount of correction to the target fixing temperature depends on the heat storage amount within the prescribed time. Accordingly, the amount of correction to the target fixing temperature is desirably prescribed taking into account the heat capacity of the fixing unit, the target fixing temperature in the case where the inter-sheet time lasts long, and the like.

When there are fluctuations in the inter-sheet time during the print time count, the print time count may not be necessarily corrected. For example, the prescribed time A, the prescribed time B, the prescribed time C, the amount of correction to the target fixing temperature may be changed as appropriate.

Figure 12A:
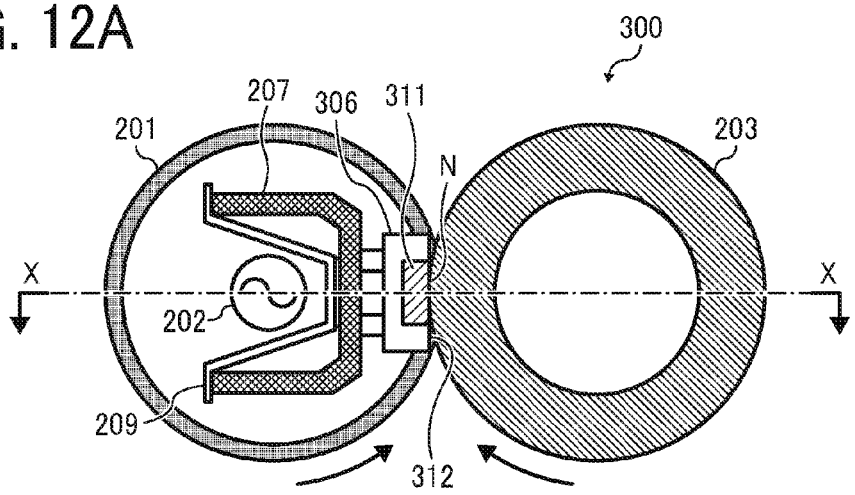
FIG. 12A is a cross-sectional side view of a variation of the fixing device according to an embodiment of the present disclosure.
Figure 12B:
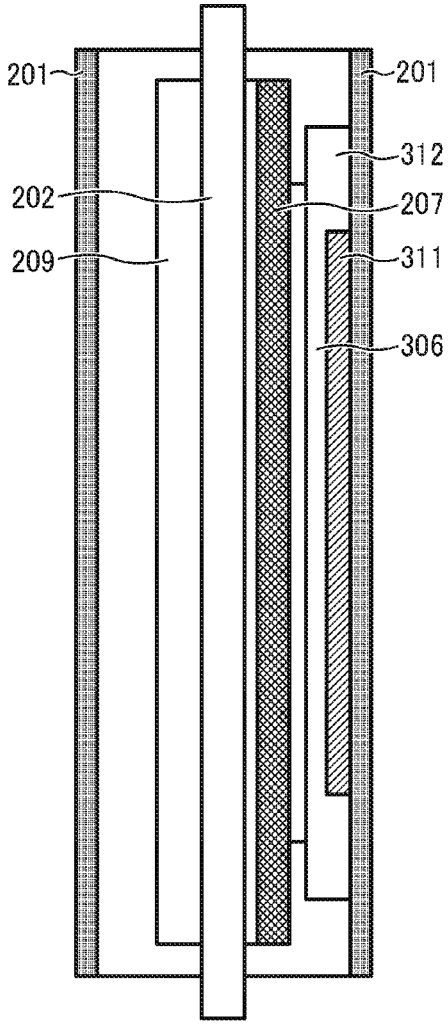
FIG. 12B is a cross-sectional plan view of the variation of the fixing device according to this embodiment, cut along line A-A of FIG. 12A.

Next, a variation of the fixing device according to the present embodiment is explained. The components in common with the above-described embodiment are given corresponding reference signs, and detailed descriptions thereof are omitted below. The different components are further described with reference to FIGS. 12A and 12B. FIG. 12A is a cross-sectional side view of the variation of the fixing device according to the present embodiment. FIG. 12B is a cross-sectional plan view of the variation of the fixing device, cut along line X-X of FIG. 12A. The fixing device of this variation is different from the fixing device according to the above-described embodiment in having a heat transfer assist member referred to as also soaking member that loosens temperature gradient in the longitudinal direction of the fixing belt.

A heat transfer assist member 311 is provided on the nip N-side surface of a nip formation pad 306. The heat transfer assist member 311 is made of highly heat-conductive metallic plate of copper or aluminum, for example. The thickness of the heat transfer assist member 311 can be selected as appropriate but may be set to 0.3 to 0.5 mm, for example. This makes it possible to transfer heat positively in the width direction of the fixing belt 201, that is, in the longitudinal direction of the heat transfer assist member 311 to loosen the temperature gradient in the longitudinal direction.

The nip formation pad 306 may be provided with a slide sheet 312. Specifically, the slide sheet 312 is provided on the surface of the nip formation pad 306 opposed to the inner circumferential face of the fixing belt 201. The slide sheet 312 is a sheet-like member provided to reduce slide resistance of the fixing belt 201 and the nip formation pad 306.

The slide sheet 312 is preferably impregnated with a lubricant to alleviate frictional load. This makes it possible to reduce friction, suppress torque increase, alleviate load on the drive source, and prevent breakage of the drive source. It is also possible to prevent a slip and avoid occurrence of an abnormal image.

There is no limitation on the method for attaching the slide sheet 312 to the nip formation pad 306. For example, the slide sheet 312 may be wound around the nip formation pad 306 and fixed to the nip formation pad 306 by at least one of an adhesive (for example, double-faced tape) and a fastener (for example, a screw).

By adhering and securing the slide sheet 312 to the nip formation pad 306, it is possible to prevent gaps and wrinkles caused by deformation and misalignment that lead to leakage of the impregnated lubricant due to breakage or stretching.

At such a fixing device 300 described above, the halogen heater 202 can be controlled by the controller 90 as explained above in relation to the above-described embodiment such that the preset temperature of initial sheet passage is kept from being raised. Such a configuration may suppress the degradation of the components and prevent hot offset and gloss reduction caused by performing repeatedly small-amount print jobs.

According to the above-described embodiments and variations, the fixing device can have a simple configuration of obtaining good fixing performance and relatively long produce life and achieving energy saving.

In the above descriptions, some embodiments and variations of the present disclosure are described. However, embodiments of the present disclosure are not limited to the above-described embodiments and variations. For example, in the above-described embodiment, the number of printed sheets may be prescribed instead of the prescribed time A and the prescribed time C. In such a case, the number of printed sheets in the previous job is counted instead of counting the print time in the previous job. In addition, the number of the printed sheets is corrected instead of correcting the counted print time in the case where the inter-sheet time lasts long.

The materials and dimensions of the components described above in the foregoing embodiment are mere examples. Needless to say, various materials and dimensions can be selected within the range in which the advantages of the present disclosure can be provided.

Numerous additional modifications and variations are possible in light of the above teachings. It is therefore to be understood that, within the scope of the above teachings, the present disclosure may be practiced otherwise than as specifically described herein. With some embodiments having thus been described, it will be obvious that the same may be varied in many ways. Such variations are not to be regarded as a departure from the scope of the present disclosure and appended claims, and all such modifications are intended to be included within the scope of the present disclosure and appended claims.

What is claimed is:

1. A fixing device comprising:

a fixing rotator;

a heat source to heat the fixing rotator;

a controller to control the heat source such that a temperature of the fixing rotator is equal to a preset fixing temperature;

a pressure rotator to contact an outer surface of the fixing rotator; and a nip formation pad inside the fixing rotator to abut the pressure rotator via the fixing rotator and form a nip between the fixing rotator and the pressure rotator, wherein, when a print time of a previous job is longer than a prescribed time A and a next job is started within a prescribed time B after an end of the previous job, the controller corrects the preset fixing temperature during a time from a start of the next job to an entry of a print sheet into the nip and during a time from the entry of the print sheet into the nip to a lapse of a prescribed time C after the entry.

2. The fixing device according to claim 1, wherein the controller adjusts at least one of the prescribed time A, the prescribed time B, the prescribed time C, and an amount of correction to the preset fixing temperature.

3. The fixing device according to claim 2, wherein the controller determines the prescribed time A and the prescribed time B based on a print mode of the previous job, and wherein the controller determines the prescribed time C and the amount of correction to the preset fixing temperature based on a print mode of the next job.

4. The fixing device according to claim 3, wherein the controller determines the prescribed time A, the prescribed time B, the prescribed time C, and the amount of correction to the preset fixing temperature based on a relationship between the print mode of the previous job and the print mode of the next job.

5. The fixing device according to claim 1, further comprising a timer to start counting the print time of the previous job at a start of a print operation of the previous job and finish counting the print time of the previous job at an end of the print operation of the previous job.

6. The fixing device according to claim 5, wherein the controller corrects the print time of the previous job when an inter-sheet time during the previous job fluctuates.

7. An image forming apparatus comprising the fixing device according to claim 1.

* * * * *